US009359059B1

(12) United States Patent
Scherer, III et al.

(10) Patent No.: US 9,359,059 B1
(45) Date of Patent: Jun. 7, 2016

(54) OUTBOARD MARINE ENGINES HAVING GEARCASE STRUTS WITH FLOW SEPARATORS

(71) Applicant: Brunswick Corporation, Lake Forest, IL (US)

(72) Inventors: John O. Scherer, III, Oshkosh, WI (US); Paul M. Radavich, Eldorado, WI (US); James E. Clevenger, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 2 days.

(21) Appl. No.: 14/556,748

(22) Filed: Dec. 1, 2014

Related U.S. Application Data

(60) Provisional application No. 61/917,647, filed on Dec. 18, 2013.

(51) Int. Cl.

| | |
|---|---|
| ***B63H 20/00*** | (2006.01) |
| ***B63H 20/34*** | (2006.01) |
| ***B63H 20/28*** | (2006.01) |
| *B63H 20/32* | (2006.01) |

(52) U.S. Cl.
CPC ..... *B63H 20/34* (2013.01); *B63H 20/28* (2013.01); *B63H 2020/323* (2013.01)

(58) Field of Classification Search
CPC ..... B63H 20/28; B63H 20/34
USPC ..... 440/76, 89 A, 89 R
See application file for complete search history.

(56) References Cited

U.S. PATENT DOCUMENTS

| | | | | |
|---|---|---|---|---|
| 4,295,835 | A | 10/1981 | Mapes et al. | |
| 4,447,214 | A | 5/1984 | Henrich | |
| 4,911,665 | A * | 3/1990 | Hetzel | B63H 20/245 440/89 R |
| 5,277,634 | A | 1/1994 | Calamia et al. | |
| 5,967,866 | A * | 10/1999 | Willows | B63H 20/34 440/76 |

* cited by examiner

*Primary Examiner* — Stephen Avila
(74) *Attorney, Agent, or Firm* — Andrus Intellectual Property Law, LLP

(57) ABSTRACT

An outboard marine engine comprises an anti-ventilation plate; a torpedo housing that is disposed below the anti-ventilation plate; and a gearcase strut that extends from the anti-ventilation plate to the torpedo housing. The gearcase strut has a leading end, a trailing end, and opposing outer surfaces that extend from the leading end to the trailing end. A flow separator is on each outer surface. The flow separator is located closer to the trailing end than the leading end and causes flow of water across the gearcase strut to separate from the outer surface.

18 Claims, 5 Drawing Sheets

OUTBOARD MARINE ENGINES HAVING GEARCASE STRUTS WITH FLOW SEPARATORS

CROSS-REFERENCE TO RELATED APPLICATION

This application claims the benefit of and priority to U.S. Provisional Patent Application No. 61/917,647, filed Dec. 18, 2013, which is hereby incorporated by reference in entirety.

FIELD

The present disclosure relates to outboard marine engines.

BACKGROUND

The following U.S. Patents are incorporated herein by reference:

U.S. Pat. No. 5,967,866 discloses a lower unit for a marine propulsion system having a flow disrupter positioned along the side wall of the vertical strut above the torpedo gearcase. The strut has a high pressure side and low pressure side which results from the strut being positioned at an angle with respect to the direction of boat travel in order to compensate for steering torque. The flow disrupter is positioned on the low pressure side of the strut, and promotes the separation of water passing over the vertical strut in a controlled manner, thereby reducing steering jerks during acceleration due to dramatic hydrodynamic flow changes. The flow disrupter consists of a series of steps or textured areas positioned along the aft section of the vertical strut. In a preferred embodiment, each of the steps contains a vent passage permitting exhaust to exit the strut through the steps to further promote controlled separation of water passing over the strut.

U.S. Pat. No. 5,277,634 discloses a lower unit for a marine propulsion device, such as an outboard motor or a stern drive unit.

U.S. Pat. No. 4,447,214 discloses a lower unit having a gearcase normally submerged in water and arranged to discharge engine exhaust gas rearwardly from the rear end into the water exteriorly of the propeller hub. A ring member or thrust ring including a hub mounted on the propeller shaft for common therewith, an annular collar and a plurality of circumferentially-spaced, radially extending spokes or ribs interconnecting the annular collar and the hub serves as a fishline and weed cutter. The annular collar includes an annular outer surface which extends closely adjacent an annular inner surface in the interior of the gearcase adjacent the trailing edge of the gearcase. In one embodiment, forward migration of the engine exhaust gases along the outer surface of the gearcase, which can cause unstable handling of the lower unit, is prevented by an anti-ventilation means including an annular section on the ring member collar located rearwardly of the annular outer surface and rearwardly of the trailing edge of the gearcase and having an outer surface tapering radially outwardly from the outer surface of the gearcase toward the propeller.

U.S. Pat. No. 4,295,835 discloses an engine driven outboard drive unit for propelling a watercraft having a vertical drive shaft driving a horizontal propeller shaft on which a propeller is mounted. The drive unit has a gearcase torpedo which houses both the propeller shaft and an annular exhaust gas passage. The exhaust passage discharges aft through the plane of the propeller. A small annular projection is formed around the aft end of the torpedo to improve high speed performance.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, an outboard marine engine comprises an anti-ventilation plate; a torpedo housing that is disposed below the anti-ventilation plate; and a gearcase strut that extends from the anti-ventilation plate to the torpedo housing. The gearcase strut has a leading end, a trailing end, and opposing outer surfaces that extend from the leading end to the trailing end. A flow separator is on each outer surface. The flow separator is located closer to the trailing end than the leading end and causes flow of water across the gearcase strut to separate from the outer surface.

BRIEF DESCRIPTION OF THE DRAWINGS

Examples of outboard marine engines are described with reference to the following Figures. The same numbers are used throughout the Figures to reference like features and like components.

DETAILED DESCRIPTION OF THE DRAWINGS

Figure 1:
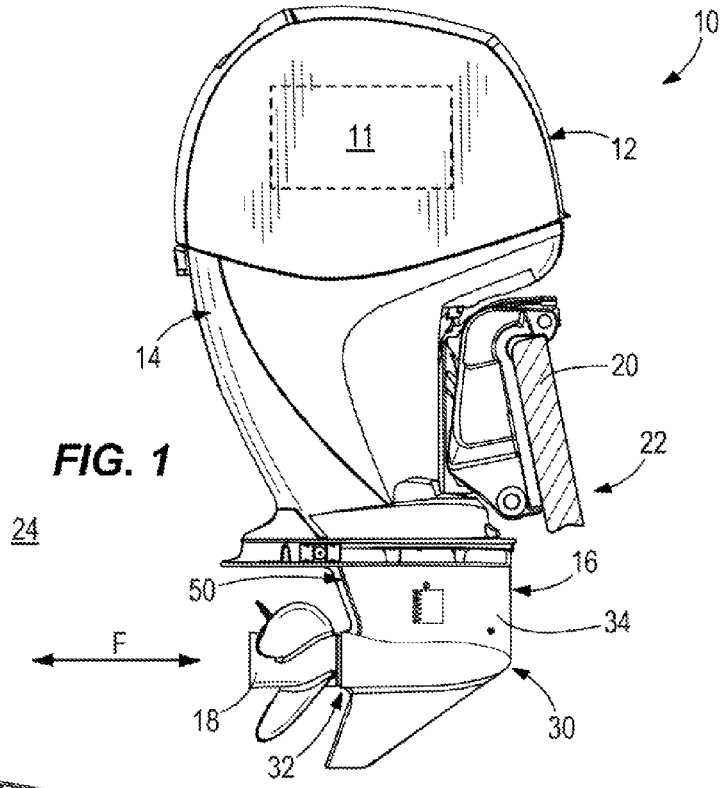
FIG. 1 is a side view of an outboard marine engine mounted to a transom of a marine vessel, wherein the outboard marine engine comprises a gearcase housing with an anti-ventilation plate, a torpedo housing, and a gearcase strut.

FIG. 1 depicts an outboard marine engine 10 having an upper cowl 12, a drive shaft housing 14 and a lower gearcase 16. The outboard marine engine 10 has an internal combustion engine 11 that drives a propeller 18 into rotation via a transmission located in the lower gearcase 16. The outboard marine engine 10 is pivotably connected to the transom 20 of a marine vessel 22. Rotation of the propeller 18 creates thrust forces F, which propels the marine vessel 22 in the surrounding water 24.

Figure 2:
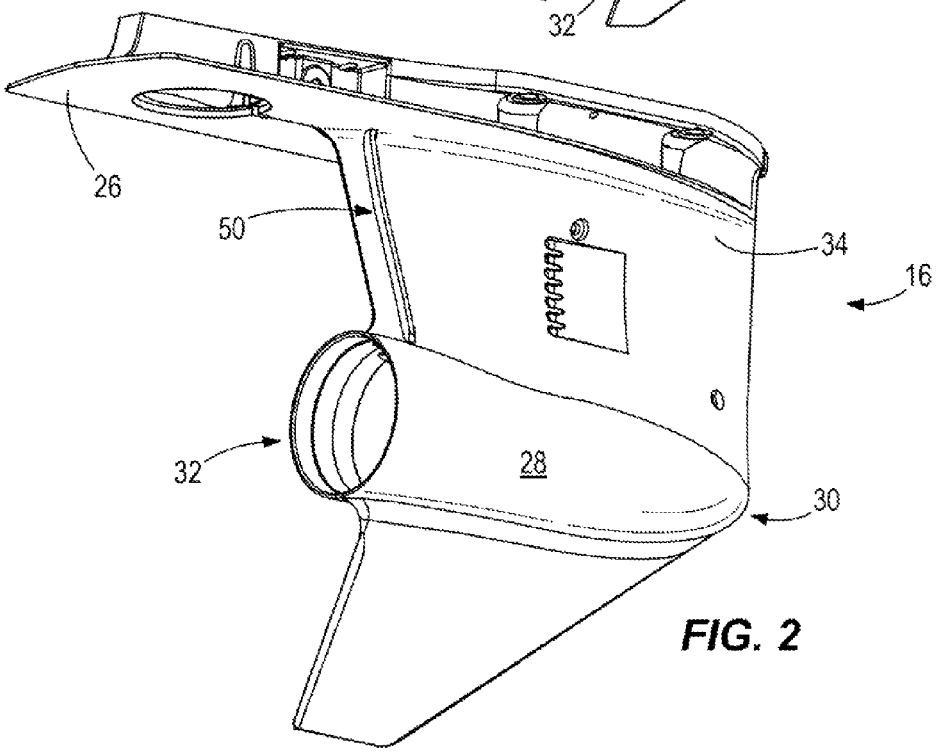
FIG. 2 is a perspective view of the gearcase housing, showing a vertically-extending flow separator extending between the anti-ventilation plate and the torpedo housing.

FIG. 2 depicts the lower gearcase 16 in more detail. The lower gearcase 16 includes an anti-ventilation plate 26 that extends horizontally with respect to the outboard marine engine 10, and laterally with respect to the lower gearcase 16. A torpedo housing 28 is disposed below the anti-ventilation plate 26 and contains portions of the noted transmission and a propeller shaft for engaging with the propeller 18, as is conventional. The torpedo housing 28 has a cone shaped leading end 30 and a cylindrical shape trailing end 32. The lower gearcase 16 has a gearcase strut 34 that vertically extends from the anti-ventilation plate 26 to the torpedo housing 28.

Figure 3:
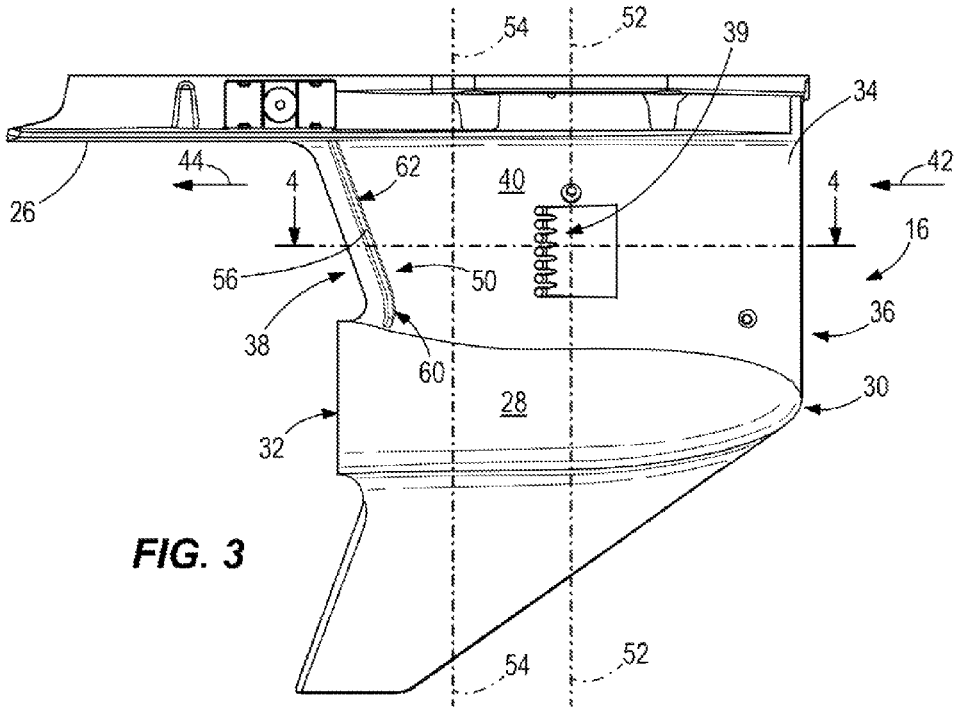
FIG. 3 is a side view of the gearcase housing.
Figure 4:
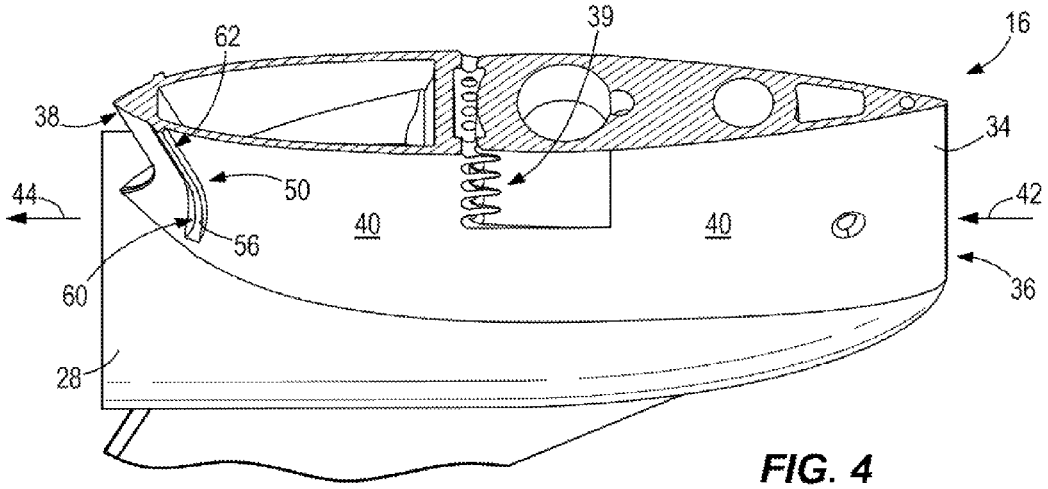
FIG. 4 is a perspective view of section 4-4, taken in FIG. 3.
Figure 5:
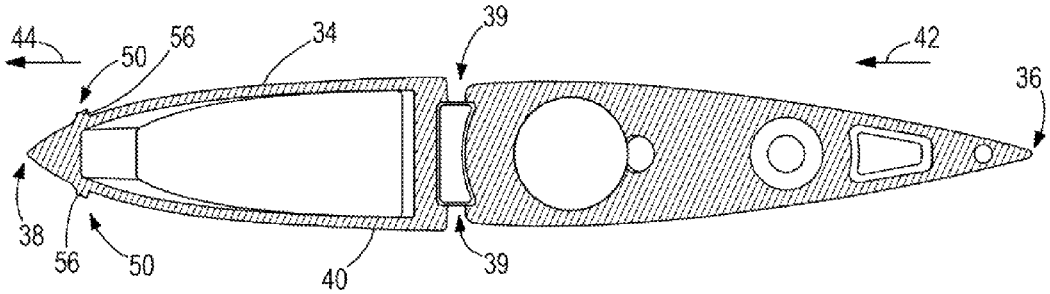
FIG. 5 is a horizontal cross-sectional top view section 4-4, taken in FIG. 3.

As shown in FIGS. 3 and 4, the gearcase strut 34 has a leading end 36, a trailing end 38, and opposing outer surfaces 40 that extend from the leading end 36 to the trailing end 38. As shown in FIGS. 4 and 5, the outer surfaces 40 are outwardly curved with respect to each other such that the gearcase strut 34 has a horizontal cross-section that is lens-shaped (see FIG. 5). During operation, as the transmission is operated in forward gear, the propeller 18 rotates and the force F propels the marine vessel 22 forwardly through the water 24. The surrounding water 24 flows across the gearcase strut 34 from upstream 42 to downstream 44, across the leading end 36, along the opposing outer surfaces 40, and then across the trailing end 38. Intake holes 39 for intake of cooling water are disposed on the outer surfaces 40.

Figure 7:
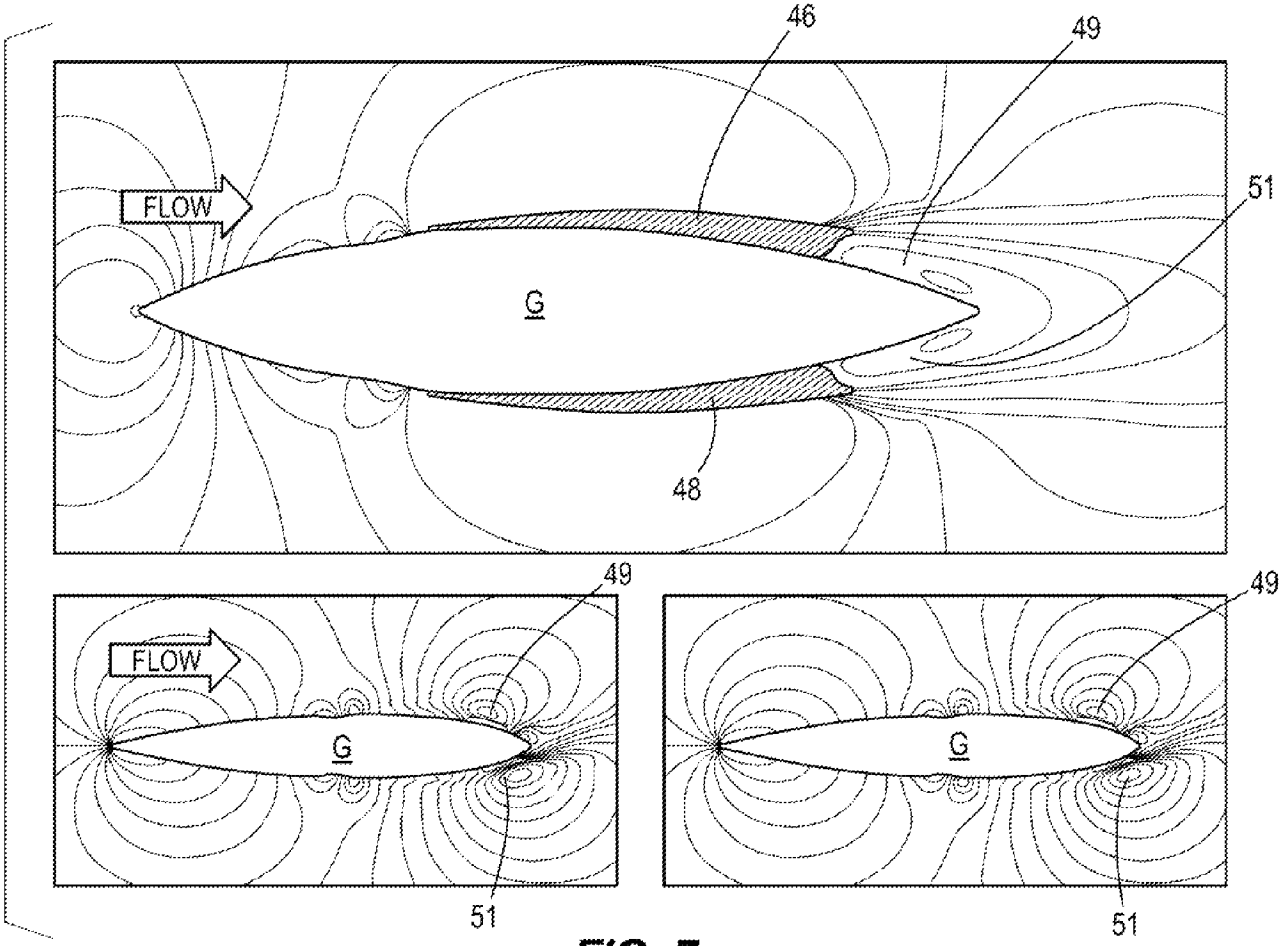
FIG. 7 PRIOR ART
FIG. 7 is prior art and shows flow of water around gearcase strut.

During research and development, the present inventors have determined that as the outboard marine engine travels through the water, flow conditions such as flow separation, cavitation, venting, and/or some combination of the three can cause the gearcase housing to oscillate. FIG. 7 is a horizontal cross-section through a prior art lower gearcase housing G. Areas of cavitation are shown in cross-hatching at reference numbers 46, 48 and areas of flow separation are shown at reference numbers 49, 51. The lower left view in FIG. 7 shows flow bent to starboard and the lower right view in FIG. 7 shows flow bent to port. The present inventors have determined that the location and magnitude of the areas 46, 48, 49, 51 can widely vary as the marine vessel travels through the water, and will depend on the specific design of the gearcase housing, the outboard marine engine, the marine vessel, the operation conditions, and various other factors. Oscillation of the gearcase housing leads to undesirable steering effects. However, the present inventors have found that due to certain design constraints (e.g., the mechanisms inside the gearcase housing), it is often not possible to design the shape of the gearcase housing to be naturally free from these unsteady effects.

Certain prior art outboard marine engines have included blowout rings (complete or partial) and propeller rings, such as those shown and described in the incorporated U.S. Pat. Nos. 4,295,835, 4,447,214, and 5,277,634, which are designed to prevent exhaust gases from venting forward over the aft end of the gearcase torpedo. However this is a different phenomenon than that described above. U.S. Pat. No. 5,967,866 discloses distributed disturbances ("flow disruptors") over the gearcase that are designed to promote separation. However the flow disruptors of the '866 patent can be costly and challenging to manufacture and can produce inconsistent results.

Referring to FIGS. 3-6, an outboard marine engine 10 according to the present disclosure has a flow separator 50 on each outer surface 40. Each flow separator 50 is located closer to the trailing end 38 than the leading end 36. The present inventors have found that each flow separator 50 advantageously causes the flow of water across the gearcase strut 34 to separate from the respective outer surface 40 in a predictable manner.

The configuration and location of the flow separator 50 can vary. In certain examples, each flow separator 50 is located closer to the trailing end 38 than a middle axis 52 (FIG. 3) of the gearcase strut 34. In further certain examples, each flow separator 50 is located closer to the trailing end 38 than a quarter axis 54 disposed midway between the middle axis 52 and the trailing end 38. Preferably, each flow separator 50 is located where the flow of water naturally separates from the outer surface 40 under most operating conditions.

Figure 6:
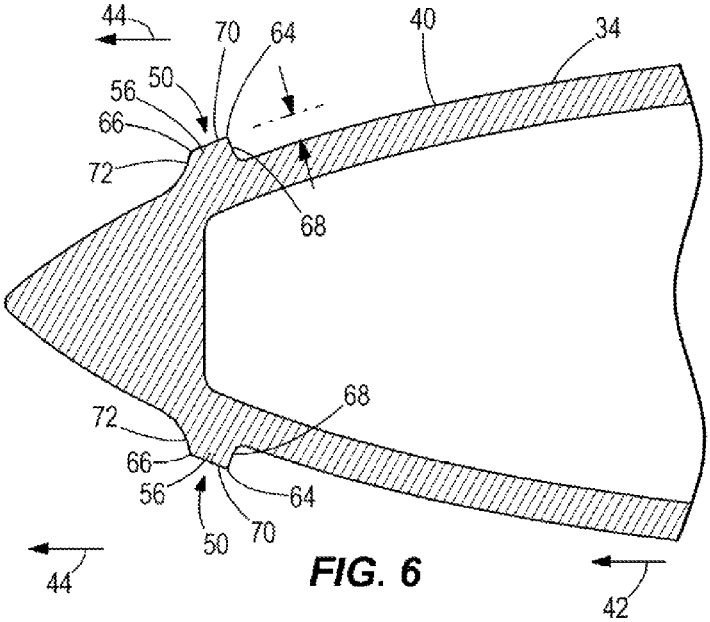
FIG. 6 is magnified view of a portion of FIG. 5.

In the examples shown in FIGS. 3-6, each flow separator 50 includes a protrusion 56 that laterally extends from the respective outer surface 40. In this example, the protrusion 56 includes a strip that vertically extends along the respective outer surface 40. The protrusion 56 is spaced from the trailing end 38 and extends parallel to the trailing end 38 along its length. The contour of the trailing end 38 and protrusion 56 can vary from that which is shown. In this example, the contour of the trailing end 38 and protrusion 56 includes a lower curved section 60 that leads to an upper straight section 62. The protrusion 56 continuously extends from the torpedo housing 28 to the anti-ventilation plate 26. However this could vary in other examples. Referring to FIG. 6, the protrusion 56 could include a plurality of protrusions that are separated along the length of the strip 58. In this example, the protrusion 56 includes a leading edge 64 and a trailing edge 66. As shown, the protrusion 56 has a horizontal cross section that is rectangular. A front surface 68 extends transversely to the flow of water from the outer surface 40 to the leading edge 64, a top surface 70 that extends parallel to the flow of water, and a downstream surface 72 that extends transversely to the flow of water from the trailing edge 66 to the outer surface 70. In other examples, the protrusion 56 can include a fillet that extends from the top surface 70 to the outer surface 40 in a curved manner. Thus the protrusion 56 can include a wedge-shaped cross section that has a thickness that decreases along the protrusion 56 from the front surface 68 to the downstream surface 72 or fillet.

Figure 8:
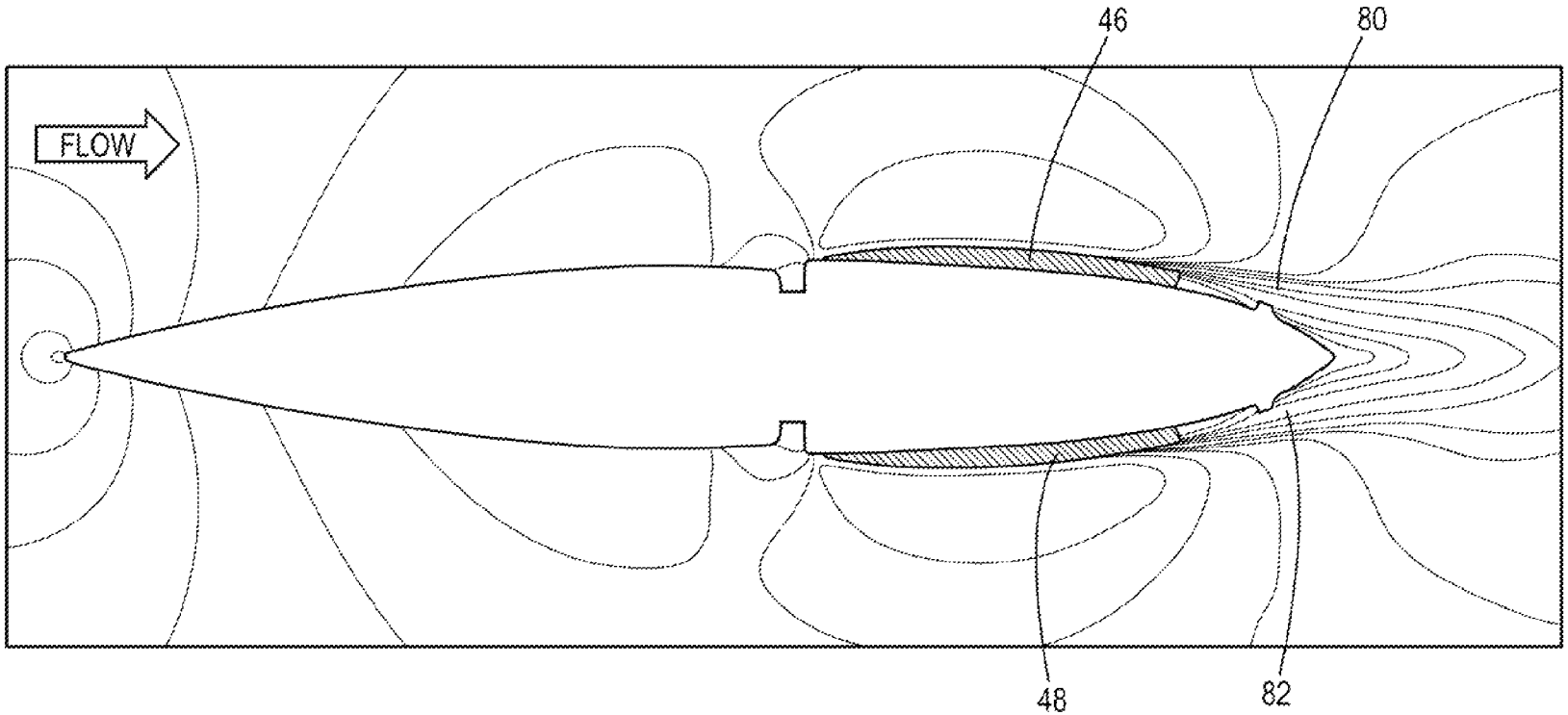
FIG. 8 shows flow of water around the gearcase strut shown in FIGS. 1-6.

The present disclosure thus provides an outboard marine engine wherein flow of water on the gearcase strut in the presence of cavitation, venting, and flow separation is stabilized by the vertically-oriented, protruding flow separators. See locations 80, 82 in FIG. 8. The flow separators are located at a well-defined fore-aft location where the flow of water on the gearcase strut naturally tends to separate. The flow separators provide a fixed, stable location for the flow to separate—even for flow that has already separated. Each flow separator, which can be nominally as thick as the separated layer, protrudes out, into the flow, producing a high pressure region to collapse any cavitation and providing a sharp edge to stabilize flow separation. See FIG. 8. This prevents movement of the separation point and the large force changes that accompany it. In certain examples, the flow separator can extend from the top of the torpedo housing to the bottom of the anti-ventilation plate near the trailing end of the gearcase strut. In certain examples, a substantially rectangular or tapered-wedge (i.e. thickness increases in aft direction) cross section may be particularly effective. In certain examples, the flow separator can have a relatively sharp front (leading) end, while the rear (trailing) edge can be softer, with a fillet as it joins back to the gearcase strut.

In the present description, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible within the scope of the appended claims.

What is claimed is:

1. An outboard marine engine comprising:

an anti-ventilation plate;

a torpedo housing that is disposed below the anti-ventilation plate;

a gearcase strut that extends from the anti-ventilation plate to the torpedo housing, wherein the gearcase strut has a leading end, a trailing end, and opposing outer surfaces that extend from the leading end to the trailing end; and a flow separator on each of the outer surfaces, wherein the flow separator is located closer to the trailing end than the leading end and causes flow of water across the gearcase strut to separate from the outer surface;

wherein each flow separator comprises a protrusion that extends from the outer surface;

wherein the protrusion comprises at least one edge; and wherein the at least one edge comprises a leading edge that faces the leading end of the gearcase strut.

2. The outboard marine engine according to claim 1, wherein each flow separator is located closer to the trailing end than a middle axis of the gearcase strut.

3. The outboard marine engine according to claim 2, wherein each flow separator is located closer to the trailing end than a quarter axis disposed midway between the middle axis and the trailing end.

4. The outboard marine engine according to claim 1, wherein the gearcase strut has a horizontal cross-section that is lens-shaped.

5. The outboard marine engine according to claim 1, wherein each flow separator is at a location where the flow of water naturally separates from the outer surface.

6. The outboard marine engine according to claim 1, wherein each flow separator comprises a protrusion that extends from the outer surface.

7. The outboard marine engine according to claim 6, wherein the protrusion comprises a strip that vertically extends along the outer surface.

8. The outboard marine engine according to claim 7, wherein the protrusion is spaced from the trailing end and wherein the protrusion extends parallel to the trailing end.

9. The outboard marine engine according to claim 8, wherein the trailing end and the protrusion each comprise a lower curved section that leads to an upper straight section.

10. An outboard marine engine comprising:

an anti-ventilation plate;

a torpedo housing that is disposed below the anti-ventilation plate;

a gearcase strut that extends from the anti-ventilation plate to the torpedo housing, wherein the gearcase strut has a leading end, a trailing end, and opposing outer surfaces that extend from the leading end to the trailing end; and a flow separator on each of the outer surfaces, wherein the flow separator is located closer to the trailing end than the leading end and causes flow of water across the gearcase strut to separate from the outer surface;

wherein each flow separator comprises a protrusion that extends from the outer surface; and wherein the protrusion continuously extends from the torpedo housing to the anti-ventilation plate.

11. The outboard marine engine according to claim 10, wherein the protrusion comprises at least one edge.

12. The outboard marine engine according to claim 1, wherein the at least one edge comprises a trailing edge that faces the trailing end of the gearcase strut and wherein the protrusion has a horizontal cross-section that is rectangular.

13. The outboard marine engine according to claim 1, wherein protrusion further comprises a front surface that extends from the outer surface to the leading edge.

14. The outboard marine engine according to claim 13, wherein the protrusion further comprises a top surface and a fillet that extends from the top surface to the outer surface.

15. The outboard marine engine according to claim 14, wherein the protrusion further comprises a wedge-shaped cross-section that has a thickness that decreases along the protrusion.

16. The outboard marine engine according to claim 1, further comprising water intake inlets located in the outer surfaces.

17. An outboard marine engine comprising:

an anti-ventilation plate;

a torpedo housing that is disposed below the anti-ventilation plate;

a gearcase strut that extends from the anti-ventilation plate to the torpedo housing, wherein the gearcase strut has a leading end, a trailing end, and opposing outer surfaces that extend from the leading end to the trailing end; and a flow separator on each of the outer surfaces, wherein the flow separator is located closer to the trailing end than the leading end and causes flow of water across the gearcase strut to separate from the outer surface;

wherein each flow separator is located closer to the trailing end than a middle axis of the gearcase strut;

wherein each flow separator is located closer to the trailing end than a quarter axis disposed midway between the middle axis and the trailing end;

wherein each flow separator comprises a protrusion that laterally extends from the outer surface;

wherein the protrusion comprises a strip that vertically extends along the outer surface; and wherein the protrusion comprises at least one edge; and wherein the at least one edge comprises a leading edge that faces the leading end of the gearcase strut.

18. An outboard marine engine comprising:

an anti-ventilation plate;

a torpedo housing disposed below the anti-ventilation plate;

a gearcase strut extending from the anti-ventilation plate to the torpedo housing, wherein the gearcase strut has a leading end, a trailing end, and opposing outer surfaces that extend from the leading end to the trailing end;

a plurality of intake holes in the opposing outer surfaces for intake of cooling water for the outboard marine engine;

a flow separator on each respective opposing outer surface between the plurality of intake holes and the trailing end, wherein the flow separator comprises a protrusion that is elongated in a direction extending between the anti-ventilation plate and the torpedo housing, the flow separator protruding outwardly from the respective opposing outer surface so as to cause flow of water across the gearcase strut to separate from the respective opposing outer surface;

wherein except for the flow separator on each respective opposing outer surface, the gearcase strut has a horizontal cross-section that is lens-shaped and continuously tapered and uninterrupted from the plurality of intake holes to the trailing end.

* * * * *